US005778079A

United States Patent [19]

Wun

[11] Patent Number: 5,778,079

[45] Date of Patent: Jul. 7, 1998

[54] SKIN TOUCH-CONTROLLED PIEZOELECTRIC MICROPHONE

[76] Inventor: Yien Chen Wun, 4F, No. 5, Alley 75, Lian Chen Road, Chungho City, Taipei Hsien, Taiwan

[21] Appl. No.: 884,190

[22] Filed: Jun. 27, 1997

[51] Int. Cl.[6] ..... H04R 25/00

[52] U.S. Cl. ..... 381/68.3; 381/151; 381/173

[58] Field of Search ..... 381/68, 68.3, 114, 381/173, 168, 169, 151, 190

[56] References Cited

U.S. PATENT DOCUMENTS 2,045,427 6/1936 White ..... 381/68.3
2,239,550 4/1941 Cubert ..... 381/68.3

*Primary Examiner*—Huyen Le
*Attorney, Agent, or Firm*—Pro-Techtor International Services

[57] ABSTRACT

A skin touch-controlled piezoelectric microphone which includes a housing having a thin bottom side that admits vibrating waves from the user's skin when the user talks, a metal base plate mounted in the housing and having a negative signal electrode contact, a signal metal plate mounted in the housing and having a positive signal electrode contact, two ceramic plates sandwiched in between the metal base plate and the signal metal plate, a PC board mounted on the metal base plate and having a negative signal electrode contact and positive signal electrode contact respectively connected to the negative signal electrode contact of the metal base plate and the positive signal electrode contact of the signal metal plate for converting the collected voice signal into an electric signal, and a signal line connected to the PC board for output of the electric signal.

4 Claims, 2 Drawing Sheets

SKIN TOUCH-CONTROLLED PIEZOELECTRIC MICROPHONE

BACKGROUND OF THE INVENTION

The present invention relates to microphones, and more particularly to a skin touch-controlled piezoelectric microphone which eliminates background noises.

Regular capacitive microphones are designed to pick up the user's voice from the air, and then to convert the received voice signal into a corresponding electric signal for output to an amplifier. These capacitive microphones are functional, however they cannot effectively eliminate the interference of background noises or the occurrence of an echo.

SUMMARY OF THE INVENTION

The present invention has been accomplished to provide a skin touch-controlled piezoelectric microphone which eliminates the aforesaid problems. It is one object of the present invention to provide a skin touch-controlled piezoelectric microphone which effectively eliminates the interference of background noises. It is another object of the present invention to provide a skin touch-controlled piezoelectric microphone which does not produce an echo. To achieve these and other objects of the present invention, there is provided a skin touch-controlled piezoelectric microphone which comprises a housing having a thin bottom side that admits vibrating waves from the user's skin when the user talks, a metal base plate mounted in the housing and having a negative signal electrode contact, a signal metal plate mounted in the housing and having a positive signal electrode contact, two ceramic plates sandwiched in between the metal base plate and the signal metal plate, a PC board mounted on the metal base plate and having a negative signal electrode contact and positive signal electrode contact respectively connected to the negative signal electrode contact of the metal base plate and the positive signal electrode contact of the signal metal plate for converting vibrating waves into a sound signal, and a signal line connected to the PC board for output of the sound signal.

DETAILED DESCRIPTION OF THE PREFERRED EMBODIMENT

Figure 1:
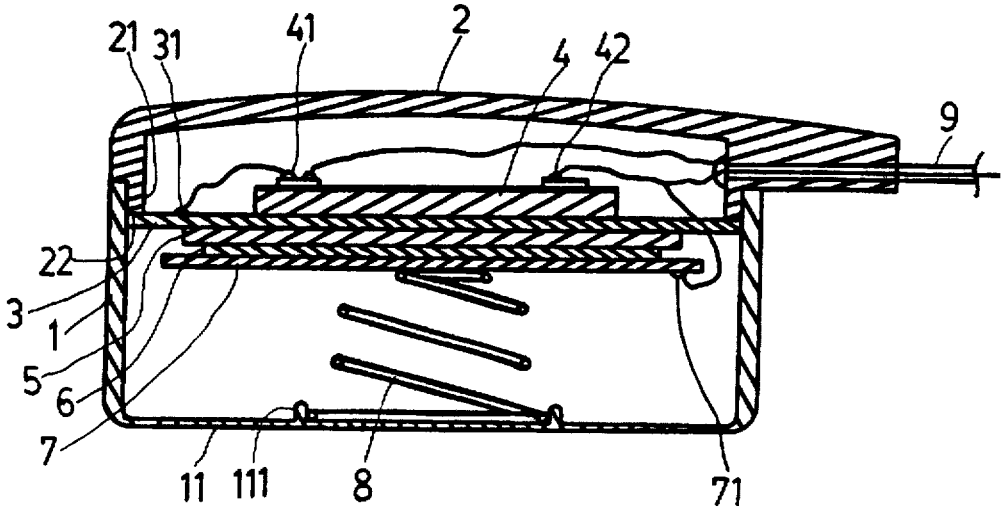
FIG. 1 is a sectional view of a skin touch-controlled piezoelectric microphone according to the present invention.

Referring to FIG. 1, a microphone in accordance with the present invention comprises a bottom shell 1, and a top cover shell 2 covered on the bottom shell 1. The bottom shell 1 has a thin bottom wall 11, which admits vibrating waves from the user's skin when the user talks, and a plurality of stub rods 111 raised from the bottom wall 11 on the inside. When the bottom shell 1 and the top cover shell 2 are closed together, they define an enclosed space. The top cover shell 2 comprises a peripheral flange 21 raised around the border and inserted into the bottom shell 1. A metal base plate 3 is fixedly fastened to the bottom edge 22 of the peripheral flange 21 of the top cover shell 2, and suspended within the bottom shell 1. A printed circuit board 4 is mounted on the metal base plate 3 within the top cover shell 2. A signal metal plate 7 is suspended within the bottom shell 1 and connected to the metal base plate 3. An upper ceramic plate 5 and a lower ceramic plate 6 are arranged in a stack and sandwiched in between the metal base plate 3 and the signal metal plate 7. A spiral spring 8 is mounted inside the bottom shell 1, having its bottom end fastened to the stub rods 111 and its top end connected to the bottom side of the signal metal plate 7. The metal base plate 3 comprises a negative signal electrode contact 31 connected to a negative signal electrode contact 41 of the printed circuit board 4 by an electric wire. The signal metal plate 7 comprises a positive signal electrode contact 71 connected to a positive signal electrode contact 42 of the printed circuit board 4 by an electric wire. The positive signal electrode contact 42 and negative signal electrode contact 41 of the printed circuit board 4 are respectively connected to a signal line 9.

When in use, the sink touch-control piezoelectric microphone is fastened to the user's body, permitting the thin bottom wall 11 of the bottom shell 1 to be disposed in close contact with the skin of the neck, cheek, chest, . . . wherein the muscles vibrates with the sound when the user talks. When the user talks, vibrating waves are transmitted from the user's skin through the thin bottom wall 11 of the bottom shell 1, the spiral spring 8, the signal metal plate 7, the lower ceramic plate 6 and the upper ceramic plate 5, and converted into a sound wave signal, the sound wave signal is than transmitted to the printed circuit board 4 and converted by it into an electric signal for output through the signal line 9 to for example an amplifier.

Figure 2:
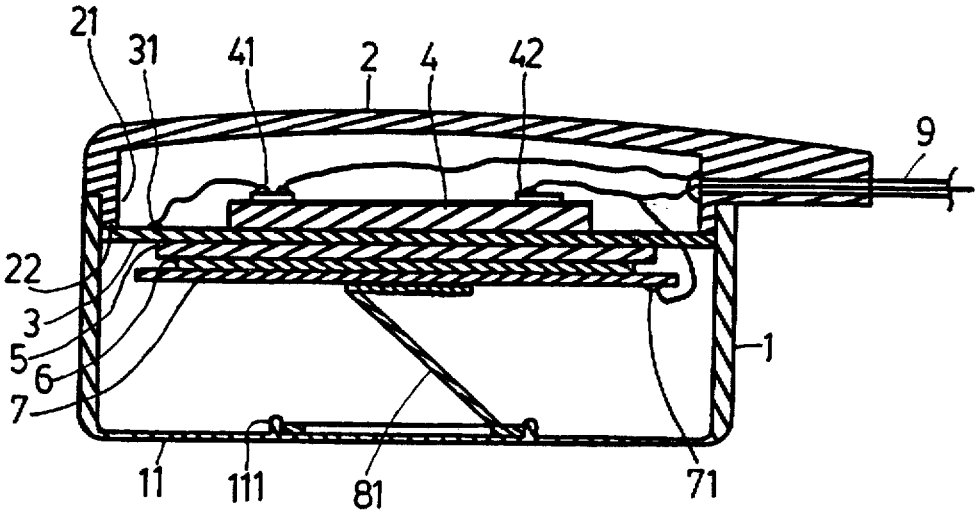
FIG. 2 is a sectional view of an alternate form of the skin touch-controlled piezoelectric microphone according to the present invention.

Referring to FIG. 2, a plate spring 81 may be used and mounted between the thin bottom wall 11 of the bottom shell 1 and the signal metal plate 7 to replace the aforesaid spiral spring 8.

Figure 3:
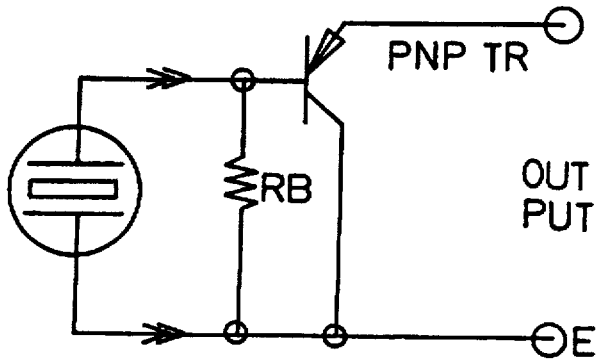
FIG. 3 is a circuit diagram of the printed circuit board according to the present invention.
Figure 4:
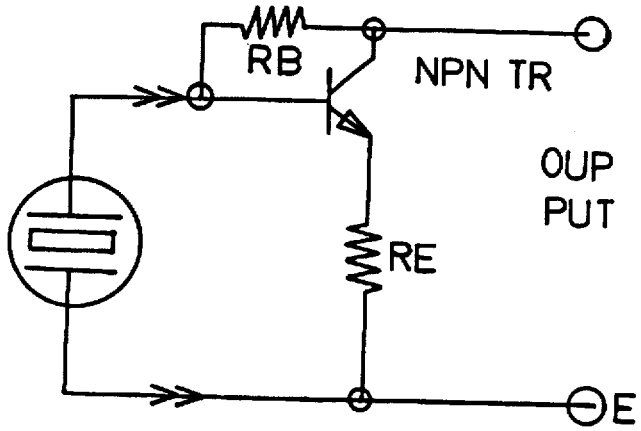
FIG. 4 is a circuit diagram of an alternate form of the printed circuit board according to the present invention.

Referring to FIGS. 3 and 4, the aforesaid printed circuit board 4 may be mounted with amplifier means or impedance matching circuit. The output impedance and signal voltage can be equal to a regular capacitive microphone. The output voltage can be as high as over 1–200 times (see FIG. 4). The signal output volume is determined subject to RE. The amplifier means can be a PNP TR (PNP transistor) or NPN TR (NPN transistor) or a FET (field effect transistor).

It is to be understood that the drawings are designed for purposes of illustration only, and are not intended as a definition of the limits and scope of the invention disclosed. For example, the number of the metal plates and the ceramic plates can be changed. If only one metal plate and one ceramic plate are used, the output signal voltage and sound quality may be changed, however the effect of the microphone can still be achieved.

What the invention claimed is:

1. A skin touch-controlled piezoelectric microphone comprising:

a bottom shell having a thin bottom wall that admits vibrating waves from the user's skin when the user talks, and a plurality of stub rods raised from said thin bottom;

a top cover shell covered on said bottom shell and defining with it an enclosed space, said top cover shell comprising a peripheral flange inserted into said bottom shell;

a metal base plate fixedly fastened to the peripheral flange of said top cover shell and suspended within said bottom shell, said metal base plate having a negative signal electrode contact connected to a negative signal electrode contact of a printed circuit board;

the printed circuit board mounted on said metal base plate within said top cover shell, having a negative signal electrode contact connected to the negative signal electrode contact of said metal base plate, and a positive signal electrode contact;

a signal metal plate suspended within said bottom shell and connected in parallel to said metal base plate, said signal metal plate having a positive signal electrode contact connected to the positive signal electrode contact of said printed circuit board;

an upper ceramic plate and a lower ceramic plate arranged in a stack and sandwiched in between said metal base plate and said signal metal plate;

metal spring means inside said bottom shell, having a bottom end connected to the stub rods of said bottom shell and a top end connected to a bottom side of said signal metal plate opposite to said lower ceramic plate; and a signal line connected to the positive signal electrode contact and negative signal electrode contact of said printed circuit board for signal output.

2. The skin touch-controlled piezoelectric microphone of claim 1, wherein said metal spring means is a spiral spring.

3. The skin touch-controlled piezoelectric microphone of claim 1, wherein said metal spring means is a plate spring.

4. The skin touch-controlled piezoelectric microphone of claim 1, wherein said printed circuit board comprises amplifier means and impedance matching circuit means.

* * * * *